US010475420B1

(12) United States Patent
Stadnyk

(10) Patent No.: US 10,475,420 B1
(45) Date of Patent: Nov. 12, 2019

(54) RECONFIGURABLE GUITAR FABRICATION METHOD

(71) Applicant: Mark A. Stadnyk, Inverness, FL (US)

(72) Inventor: Mark A. Stadnyk, Inverness, FL (US)

( * ) Notice: Subject to any disclaimer, the term of this patent is extended or adjusted under 35 U.S.C. 154(b) by 283 days.

(21) Appl. No.: 15/372,322

(22) Filed: Dec. 7, 2016

(51) Int. Cl.
*G10D 1/08* (2006.01)
*G10D 3/06* (2006.01)

(52) U.S. Cl.
CPC ..... *G10D 1/085* (2013.01); *G10D 3/06* (2013.01)

(58) Field of Classification Search
CPC ..... G10D 1/085; G10D 3/06
See application file for complete search history.

(56) References Cited

U.S. PATENT DOCUMENTS 2,561,551 A * 7/1951 Allen ..... G10D 1/085 84/723
2,795,988 A * 6/1957 Maccaferri ..... G10D 3/06 84/267
2,803,982 A * 8/1957 Gassin ..... A45C 11/24 84/275
3,072,007 A * 1/1963 Burke ..... G10D 1/085 84/267
3,396,621 A * 8/1968 Dycus ..... G10D 1/085 84/267
4,145,948 A * 3/1979 Turner ..... G10D 1/005 84/293
4,189,974 A * 2/1980 Martin ..... G10D 3/06 84/293
4,433,603 A * 2/1984 Siminoff ..... G10H 1/32 84/267
4,573,391 A * 3/1986 White ..... G10D 1/08 84/291
5,018,423 A * 5/1991 Bunker ..... G10D 3/06 84/293
5,131,307 A * 7/1992 Castillo ..... G10D 1/085 84/267
5,347,904 A * 9/1994 Lawrence ..... G10D 1/08 84/291
5,421,233 A * 6/1995 Bunker ..... G10D 3/06 84/293
5,631,432 A * 5/1997 Muncy ..... G10D 3/06 84/293
5,929,362 A * 7/1999 Oteyza ..... G10D 1/085 84/293
5,945,614 A * 8/1999 White ..... G10D 3/02 84/267
5,994,633 A * 11/1999 Norton ..... G10D 1/085 84/290

(Continued)

FOREIGN PATENT DOCUMENTS

CA 2166047 A1 * 6/1997 ..... G10D 1/085
DE 2831666 A1 * 2/1980 ..... G10D 1/085

(Continued)

*Primary Examiner* — Jacob J Cigna

(57) ABSTRACT

Providing a headstock, neck, core assembly, upper body, lower body, and control module. Attaching the headstock to the to the neck by sliding the headstock sideways into to neck via a dovetail joint. Attaching the neck to the core assembly via a tapered trapezoidal block on the neck which slides into a trapezoidal hole on the core assembly. Attaching the upper body and the lower body magnetically to the sides of the core assembly.

5 Claims, 7 Drawing Sheets

(56) References Cited

U.S. PATENT DOCUMENTS 6,025,548 A * 2/2000 Ehrlich ..... G10D 1/08 84/267
6,046,393 A * 4/2000 Rose ..... G10D 1/085 84/267
6,046,397 A * 4/2000 Rose ..... G10H 3/182 84/743
6,051,773 A * 4/2000 Rose ..... G10H 3/18 84/743
6,137,039 A * 10/2000 Rose ..... G10H 1/44 84/290
6,194,644 B1 * 2/2001 Hendrickson ..... G10D 1/085 84/267
6,194,645 B1 * 2/2001 Rose ..... G10H 1/44 84/313
6,198,030 B1 * 3/2001 Rose ..... G10H 1/44 84/290
6,376,756 B1 * 4/2002 Beckmeier ..... G10D 3/06 84/293
6,693,233 B1 * 2/2004 Sewell ..... G10D 1/08 84/267
6,911,590 B2 * 6/2005 Childress ..... G10D 1/00 84/291
7,285,708 B1 * 10/2007 Beckmeier ..... G10D 3/06 84/314 R
7,442,865 B2 * 10/2008 Moghaddam ..... G10D 1/085 84/267
7,816,592 B2 * 10/2010 Babicz ..... G10D 3/06 84/267
8,378,192 B1 * 2/2013 Harmon ..... G10D 1/085 84/291
8,962,956 B2 * 2/2015 Allred, III ..... G10D 3/06 84/293
9,378,711 B1 * 6/2016 Stadnyk ..... G10D 1/085
9,721,542 B2 * 8/2017 Sperr ..... G10D 1/085
9,852,718 B1 * 12/2017 Kelly ..... G10D 1/085
2003/0164080 A1 * 9/2003 Childress ..... G10D 1/00 84/291
2006/0123971 A1 * 6/2006 Moghaddam ..... G10D 1/085 84/290
2017/0110097 A1 * 4/2017 Sperr ..... G10D 1/085
2018/0075824 A1 * 3/2018 Gorsuch ..... G10D 1/08
2018/0211639 A1 * 7/2018 Niiro ..... G10D 1/08

FOREIGN PATENT DOCUMENTS

DE 102010034179 A1 * 9/2011 ..... G10H 1/32
GB 2555109 A * 4/2018 ..... G10D 1/085
GB 2561847 A * 10/2018 ..... G10D 1/085
JP 2017072652 A * 4/2017 ..... G10D 1/08
WO WO-2010112183 A1 * 10/2010 ..... G10D 1/085

* cited by examiner

FIG. 8
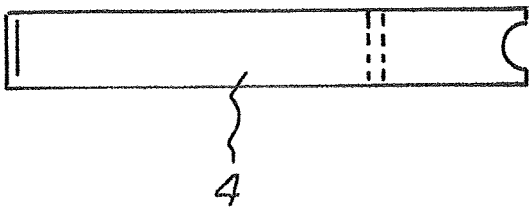
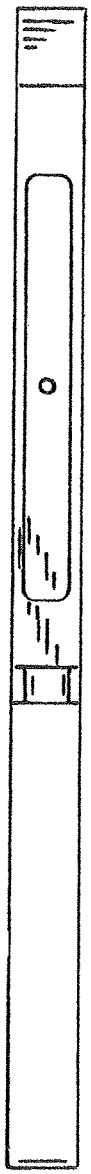
FIG. 7
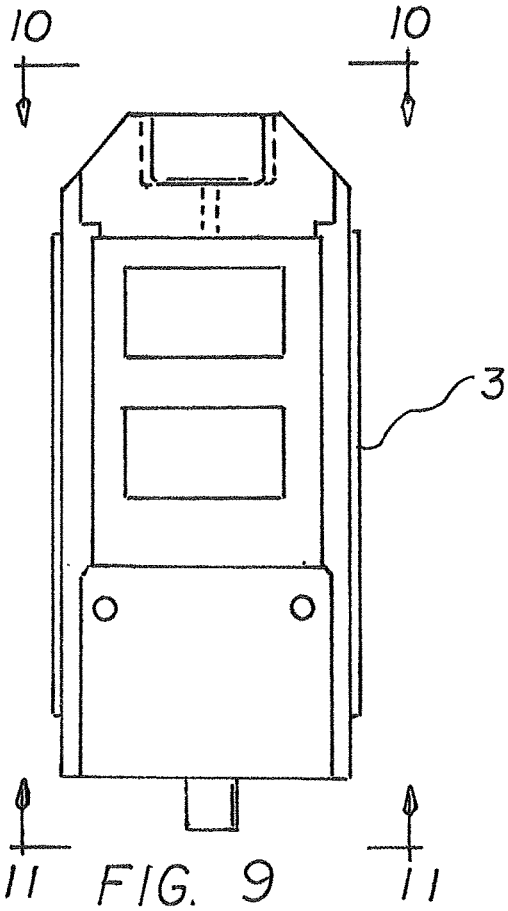
FIG. 9

FIG. 10
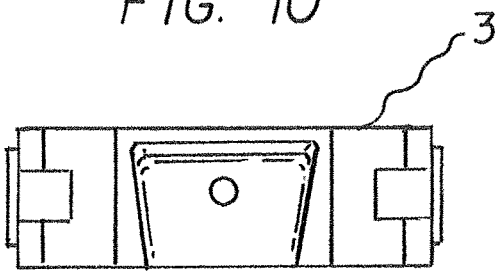
FIG. 11
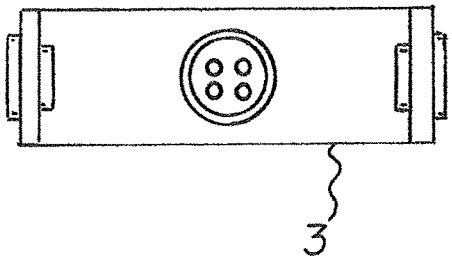
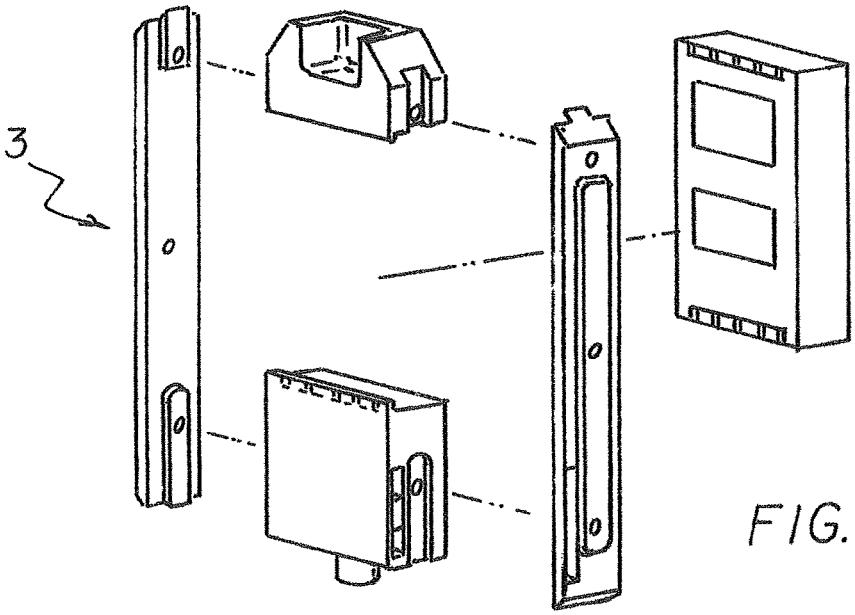
FIG. 12

RECONFIGURABLE GUITAR FABRICATION METHOD

BACKGROUND OF THE INVENTION

Field of the Invention

The present invention relates to a reconfigurable guitar fabrication method and more particularly pertains to constructing reconfigurable guitars from interlocking components for greater flexibility.

Description of the Prior Art

The use of guitar fabrication methods is known in the prior art. More specifically, guitar fabrication methods previously devised and utilized for the purpose of guitar fabrication are known to consist basically of familiar, expected, and obvious steps, notwithstanding the myriad of designs encompassed by the crowded prior art which has been developed for the fulfillment of countless objectives and requirements.

While known methods fulfill their respective, particular objectives and requirements, they do not describe constructing reconfigurable guitars from interlocking components for greater flexibility.

In this respect, the reconfigurable guitar fabrication method according to the present invention substantially departs from the conventional methods of the prior art, and in doing so provides an apparatus primarily developed for the purpose of reconfigurable guitar fabrication.

Therefore, it can be appreciated that there exists a continuing need for a new and improved reconfigurable guitar fabrication method which can be used for constructing reconfigurable guitars from interlocking components for greater flexibility. In this regard, the present invention substantially fulfills this need.

SUMMARY OF THE INVENTION

In view of the disadvantages inherent in the known types of guitar fabrication methods now present in the prior art, the present invention provides an improved reconfigurable guitar fabrication method. As such, the general purpose of the present invention, which will be described subsequently in greater detail, is to provide a new and improved reconfigurable guitar fabrication method which has all the advantages of the prior art and none of the disadvantages.

To attain this, from a broad perspective, the present invention essentially comprises the steps of providing a headstock, neck, core assembly, upper body, lower body, and control module; attaching the headstock to the neck by sliding the headstock sideways into the neck via a dovetail joint or tongue and groove interlocking method; attaching the neck to the core assembly via a tapered trapezoidal block on the neck which slides into a trapezoidal hole on the core assembly, and attaching the upper body and the lower body magnetically to the sides of the core assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the steps set forth in the following description and components illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent methods insofar as they do not depart from the spirit and scope of the present invention.

It is therefore an object of the present invention to provide a new and improved reconfigurable guitar fabrication method which has all of the advantages of the prior art guitar fabrication methods and none of the disadvantages.

It is another object of the present invention to provide a new and improved reconfigurable guitar fabrication method which may be easily and efficiently utilized.

It is a further object of the present invention to provide a new and improved reconfigurable guitar fabrication method which is reliable.

An even further object of the present invention is to provide a new and improved reconfigurable guitar fabrication method which is susceptible of a low cost and which accordingly is then susceptible of low prices of sale to the consuming public, thereby making such reconfigurable guitar fabrication method economically available.

Lastly, it is an object of the present invention to provide a reconfigurable guitar fabrication method for constructing reconfigurable guitars from interlocking components for greater flexibility.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a side elevational view taken along line 7-7 of FIG. 3.

FIG. 8 is a bottom view taken along line 8-8 of FIG. 3.

FIG. 9 is a front elevational view of the neck block shown in FIGS. 1 and 3.

FIG. 10 is a plan view taken along line 10-10 of FIG. 9.

FIG. 11 is a bottom view taken along line 11-11 of FIG. 9.

FIG. 12 is an exploded view of the headstock shown in FIGS. 1 and 2.

The same reference numerals refer to the same parts throughout the various Figures.

DESCRIPTION OF THE PREFERRED EMBODIMENT

Figure 1:
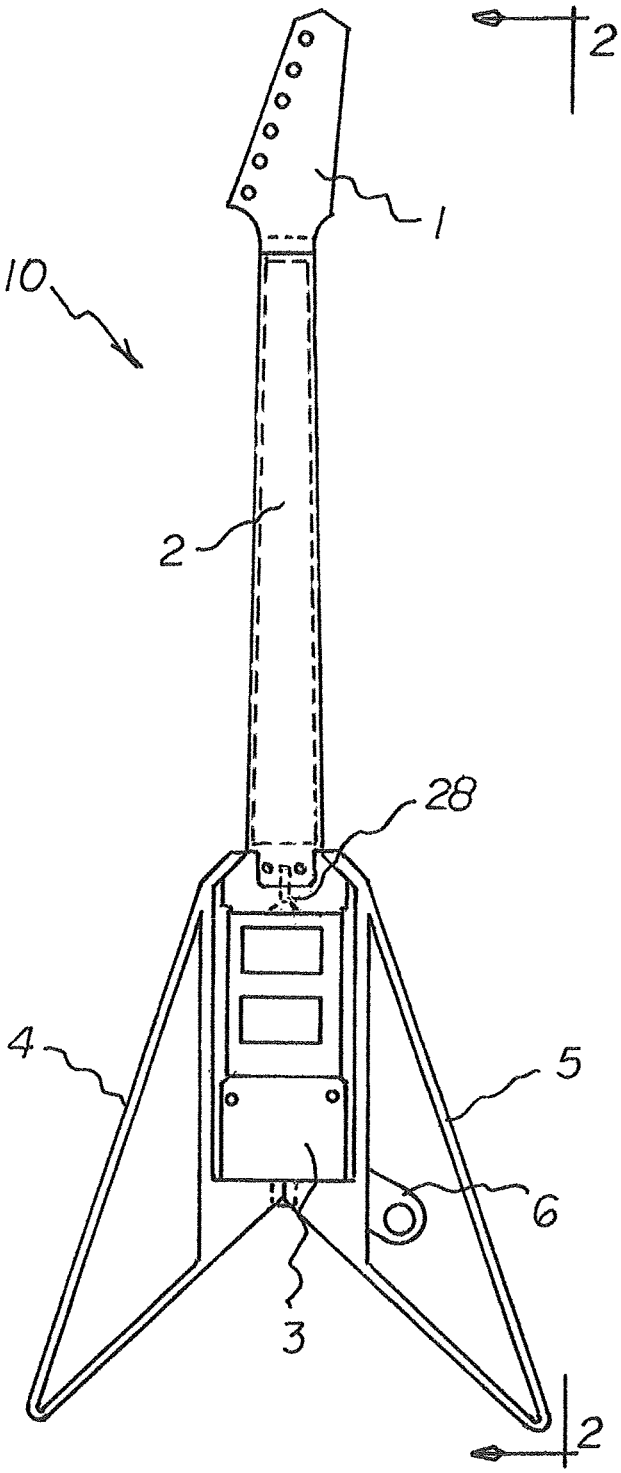
FIG. 1 is a front elevational view of a reconfigurable guitar constructed in accordance with the principles of the present invention.
Figure 2:
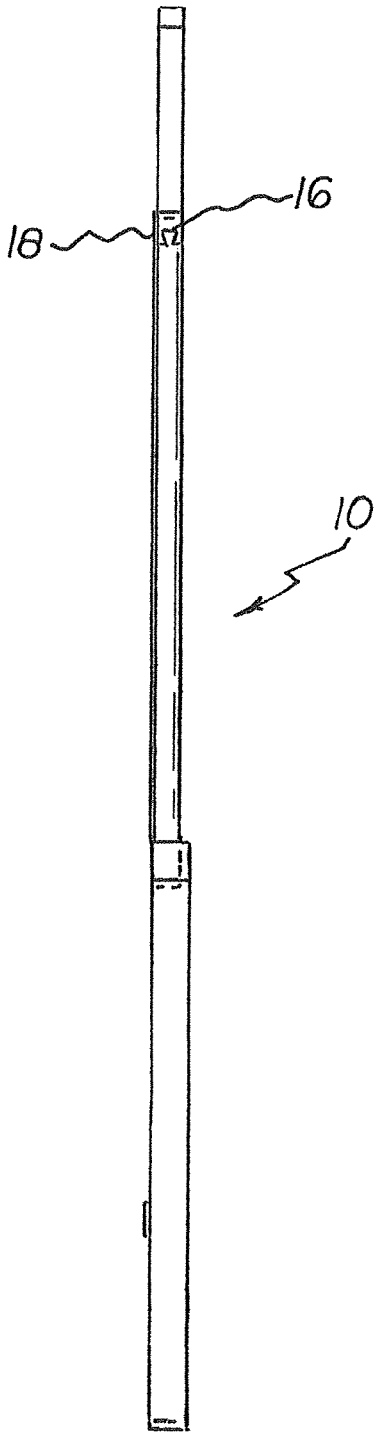
FIG. 2 is a side elevational view taken along line 2-2 of FIG. 1.
Figure 3:
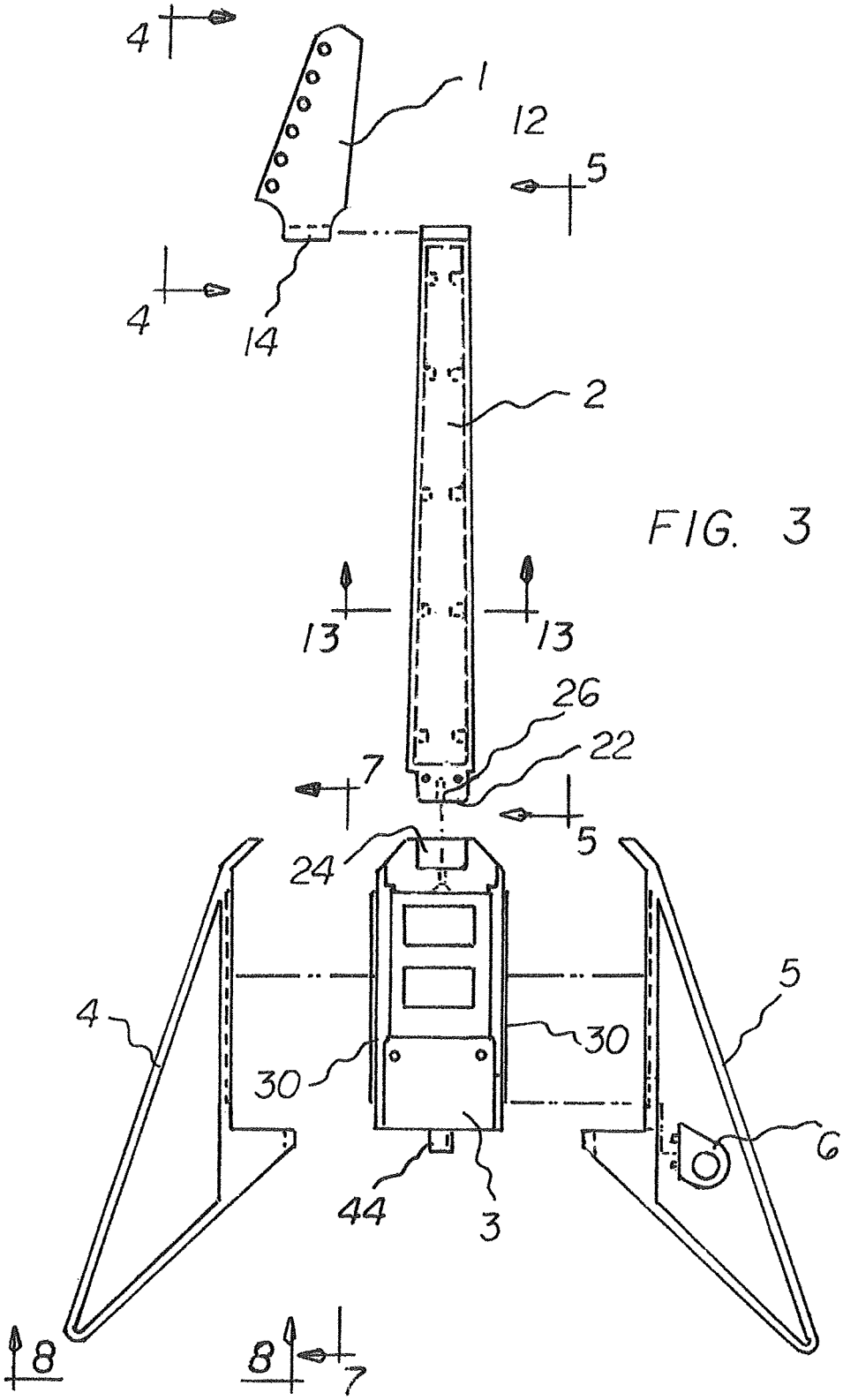
FIG. 3 is an exploded view of the reconfigurable guitar shown in FIGS. 1 and 2.
Figure 4:
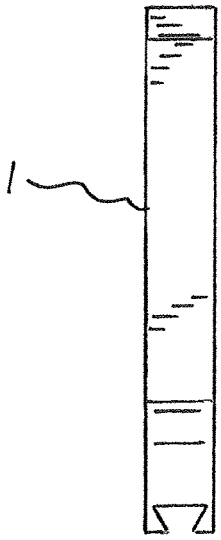
FIG. 4 is a side elevational view taken along line 4-4 of FIG. 3.
Figure 6:
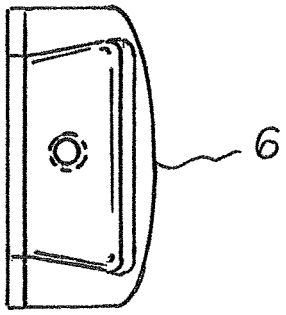
FIG. 6 is a bottom view taken along line 6-6 of FIG. 5.
Figure 5:
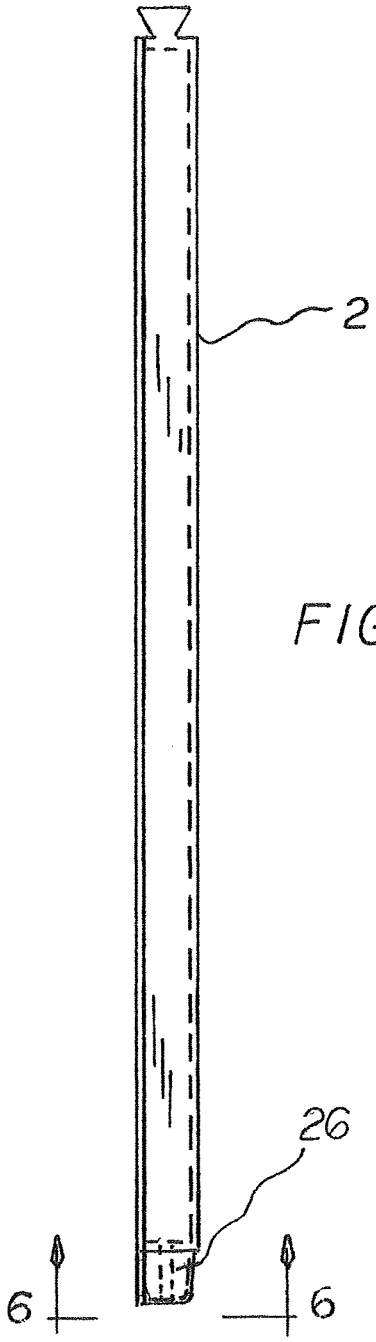
FIG. 5 is a side elevational view taken along line 5-5 of FIG. 3.
Figure 13:
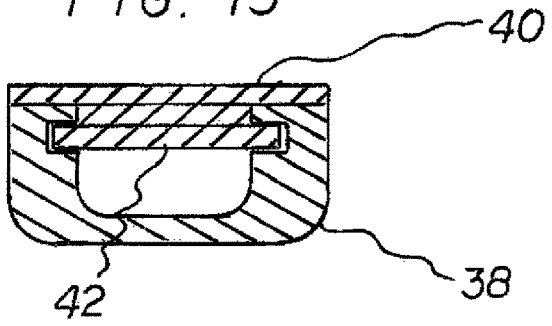
FIG. 13 is a cross sectional view taken along line 13-13 of FIG. 3.

With reference now to the drawings, and in particular to FIG. 1 thereof, the preferred embodiment of the new and improved reconfigurable guitar 10 fabrication method embodying the principles and concepts of the present invention will be described.

The present invention, the reconfigurable guitar fabrication method is comprised of a plurality of steps. The components in their broadest context include a headstock, neck, core assembly, upper body, lower body, and control module. The method steps are individually configured and correlated with respect to each other so as to attain the desired objective.

From a specific perspective, the invention of the present application includes a plurality of steps.

The first step is providing a headstock 1, neck 2, core assembly 3, upper body 4, lower body 5, and control module 6.

The next step is attaching the headstock to the neck by sliding sideways into it via a dovetail joint. The neck has a male dovetail protrusion 12. The headstock has a dovetail slot 14. The headstock also has a hole 16 through the dovetail slot so that a screw 18 can be inserted from behind into a threaded hole in the dovetail protrusion on the neck to provide for a more secure connection and proper centering.

The next step is attaching the core assembly via a tapered trapezoidal block 22 on the neck which slides into a trapezoidal hole 24 on the core assembly. Note that a rectangular block sliding into a rectangular hole would not lock up completely and could potentially wiggle around. By making the rear surface of the hole, and the block, slightly tapered inward, inserting one into the other means as you go deeper into the hole, the two parts essentially jam up together as the tapered surface at the rear forces the block forward. The protruding block at the bottom of the neck has a threaded hole 26 in it so that you can insert a screw 28 up through the middle of the core assembly so that when you tighten you fully pull the neck inward and wedge it in place securely. This tapered post/socket feature may be a novel innovation for assembling this type of product.

The upper body and the lower body are designed to couple magnetically to the sides 30 of the core assembly which is also a novel construction method and feature allowing the upper body and the lower body to quickly and easily be interchanged with other shapes, sizes and styles of guitar body. Furthermore, the control module also magnetically couples to the lower body allowing the user to switch out controls from one knob to two or more, or knobs and switches, whatever their needs are. The upper body, the lower body and the control module therefore necessarily also have electrical contacts facing each other on their inside surfaces so that when coupled together the electrical connections make contact and signals can flow to and from the electrical components in the core assembly.

The neck is formed of an inner section 38, an outer section 40 which is the fretboard, and an intermediate section 42 which is a retaining plate, arranged with spacings to facilitate the positioning of wires there within. The fretboard is constructed of wood, plastic, composite or metal. The retaining plate is formed of metal, plastic or a composite. The inner section is formed of metal.

Figure 14:
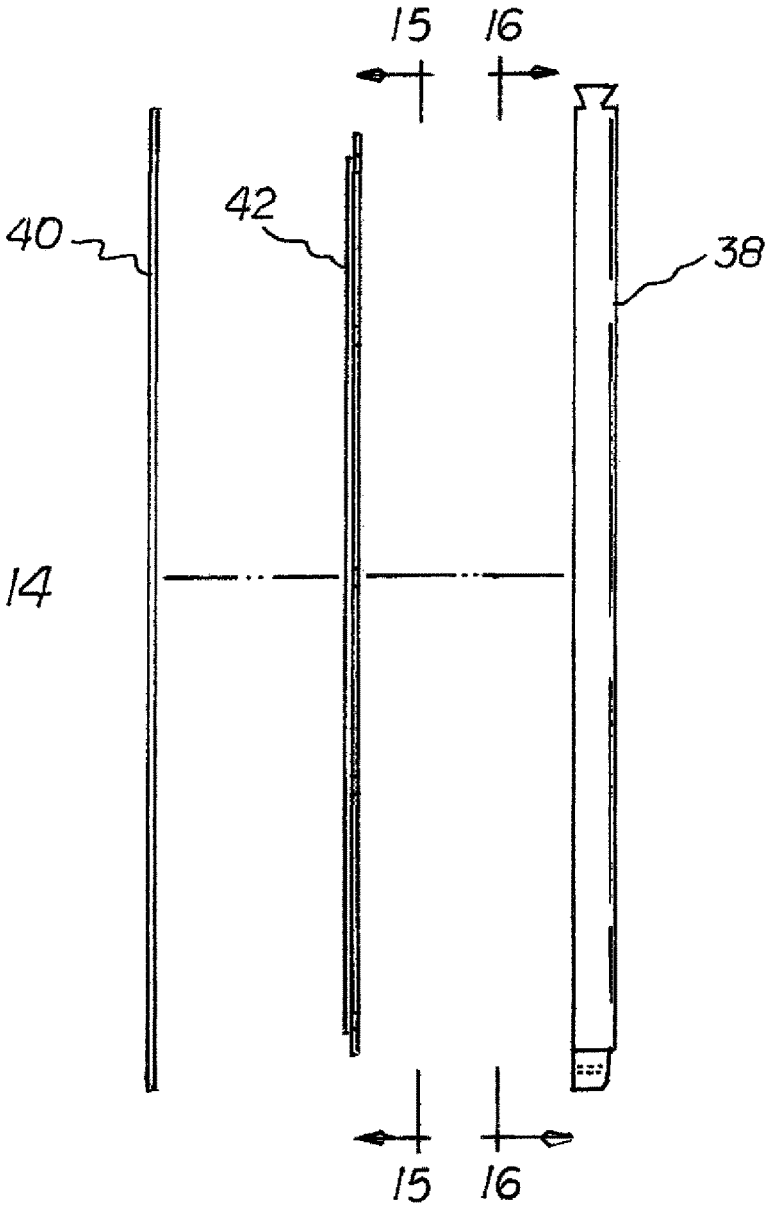
FIG. 14 is an exploded view of the neck shown in FIGS. 1 and 3.
Figure 15:
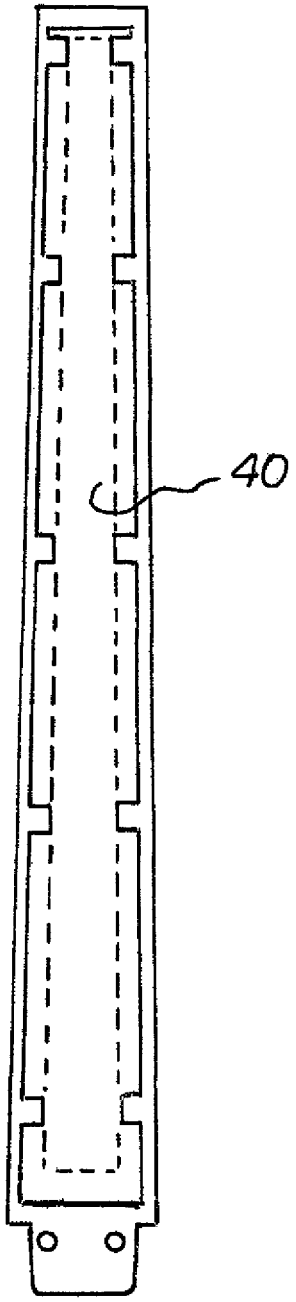
FIG. 15 is a front elevational view taken along line 15-15 of FIG. 14.
Figure 16:
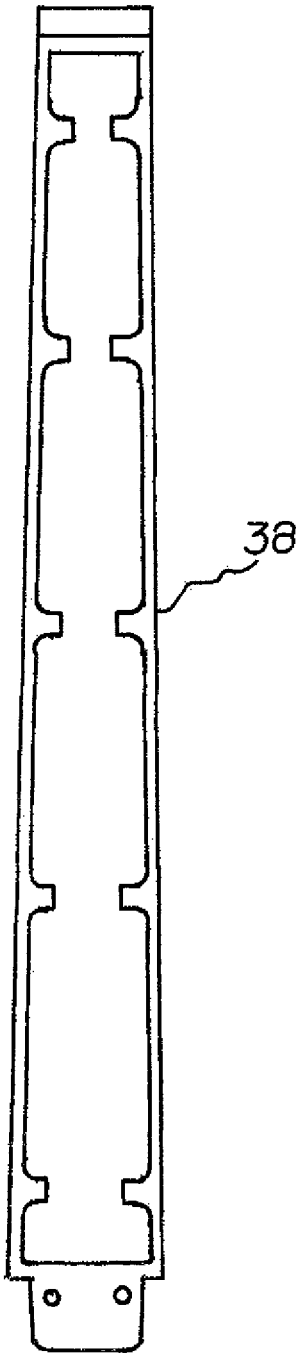
FIG. 16 is a front elevational view taken along line 16-16 of FIG. 14.

Traditionally, the fretboard is permanently glued to the guitar neck. The present method makes it easily removable. The intermediate section 42 which is a retaining plate is glued and/or screwed to the bottom of the outer section 40 which is the fretboard to make a fretboard assembly. The retaining plate has notches which correspond to the internal tabs inside the neck cavity. Each of these tabs has an undercut slot. With the fretboard assembly set over the corresponding neck tabs, it places the retaining plate below the surface level of the neck, and precisely in line with the undercut tab slots. This allows the fretboard assembly to be slid upward (toward the top of the neck) which in turn causes the wider portions of the coupling plate to slide into the undercut notches thereby locking it down to the surface of the neck. A retaining latch or screw would prevent the fretboard assembly from sliding out of position, but could easily be released to allow one fretboard to be interchanged with another at any time. Note FIG. 14. This removable fretboard is a heretofore unheard of and unique construction, an entirely new feature in guitars, which allows the removal and installation of a different fretboard without disassembling any other part of the guitar.

In addition, electrical connections also embedded in the top of core assembly and the bottom of the neck with wires running up through the hollow structure of the neck and connecting to contacts on the top mating surface of the neck which in turn couple to contacts on the bottom mating surface of the headstock. This is another novel approach to transmitting electrical signals and/or power throughout the interchangeable and interconnecting structures of the instrument without impeding the ability of the various parts to easily be removed or installed.

The projection 44 on the bottom of the core assembly is not a requirement for the coupling of the upper body and the lower body however it can serve multiple purposes and is not necessarily integral to the bottom block of the core assembly. This may be a separately attached piece which functions:

a. to align and center the bottoms of the upper body and the lower body, although the tapered cavities on the sides of the core assembly perform this function also;

b. as a rotating cam lock to positively retain and secure the upper body and the lower body once they are coupled to the core assembly magnetically;

c. as a mounting point for the strap button;

d. as the mounting point for the output jack;

Although the upper body, the lower body and the control module magnetically couple to each other, there will also be mechanical attachment points such as holes on the insides of the upper body and the lower body so that you can run machine screws into the core assembly to secure these body parts semi-permanently. There would also be a hole in the bottom of the control module with a co-axial threaded hole in the lower body so one could supplement the magnetic coupling with a mechanical screw connection or similar connection.

These drawings do not show the rectangular block that inserts into the core assembly from the back and couples magnetically to the core assembly. This block is conventional and holds the guitar pickups and also has electrical contacts on the perimeter which mate to corresponding contacts on the inside perimeter of once the block is inserted and coupled in place. This block was illustrated in previous drawings but is critical because the construction method allowing the guitar pickups to be removed or inserted easily at will is a very novel design feature.

The concept of the reconfigurable guitar is achieved by a unique and new construction method. Traditionally, a reconfigurable guitar consists of only two components: a neck and a body. Those two components are fastened together and all of the hardware and electronics are bolted to them. My construction method uses a multitude of interlocking aluminum (or plastic or composite, components allowing a greater flexibility in construction. The advantages are:

1. Lower manufacturing cost. It is cheaper to machine smaller aluminum pieces than to try to machine a large complicated item from a single block of material.

2. Upgradeability. Can upgrade just one or two components rather than having ti replace the entire reconfigurable guitar.

3. Materials interchangeability. Can use multiple materials throughout the reconfigurable guitar's construction to optimize strength, performance, weight, appearance, and other properties.

4. Reconfigurability. Using multiple interlocking parts allows manufacturer to mass-produce key components without having to stock completed finished products. Also allows end user to replace, rebuild, reconfigure any one or more components as needed ro desired.

Interlocking grooves and steps provide for precision positioning and tight fit of the various components. The various parts may be fastened together with screws, and may also be magnetically coupled together to provide for instant and tool-less interchangeability.

The primary components are as follows:

Headstock (not shown in images)
Neck
Upper Body
Lower Body
Core

The core further consists of the following interlocking components:

Neck block (joins to neck)
Bridge block
Left side panel
Right side panel
Pickup insert block The first four core components would interlock and be screwed together to form a core assembly. The Pickup Insert Block can then be inserted into the core assembly and held in by magnets or latches. The neck is bolted to the core assembly, and the headstock is in turn bolted to the end of the neck. The Upper body and lower body would then magnetically couple to the left and right sides of the Core Assembly to complete the reconfigurable guitar. The body parts would also have fastener holes to allow the final construction to be held together mechanically if so desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reconfigurable guitar fabrication method comprising the steps of:

providing a headstock, neck, core assembly, upper body, and separate lower body, the core assembly having a downwardly extending extension, the upper body and the lower body each having a long edge and a short edge perpendicular to the long edge;

attaching the headstock to the neck by sliding the headstock sideways into the neck via a dovetail joint;

attaching the neck to the core assembly via a trapezoidal block on the neck which slides into a hole on the core assembly;

attaching the upper body and the lower body to the sides of the core assembly; and rotating a cam lock projection on the bottom of the core assembly to positively retain and secure the upper body and the lower body to the core assembly.

2. The method as set forth in claim 1 and further including the step of positioning a control module in the upper body.

3. The method as set forth in claim 1 wherein the upper body and the lower body are coupled to the core assembly magnetically.

4. A reconfigurable guitar fabrication method comprising the steps of:

providing a headstock (1), neck (2), core assembly (3), upper body (4), separate lower body (5), and control module (6), the upper body and the lower body each having a long edge and a short edge perpendicular to the long edge;

attaching the headstock to the neck by sliding the headstock sideways via a tongue and groove interlocking method whereby the headstock and the neck are connected and properly centered;

attaching the neck to the core assembly via a tapered trapezoidal block (22) on the neck which slides into a trapezoidal hole (24) on the core assembly, the core assembly also including a protruding block at the bottom of the neck with a threaded hole (26) whereby a screw (28) in the protruding block secures the neck to the core assembly;

attaching the upper body (4) and the lower body (5) to sides (30) of the core assembly, positioning the control module (6) in the upper body with the neck (2) being formed of an inner section (38), an outer section (40), and an intermediate section (42) arranged with spacings to facilitate the positioning of wires; and rotating a cam lock projection (44) on the bottom of the core assembly to positively retain and secure the upper body and the lower body to the core assembly.

5. The method as set forth in claim 4 wherein the step of attaching the headstock to the neck is via a dovetail joint comprising a dovetail recess (12) on the neck and a dovetail protrusion (14) on the headstock, providing a hole (16) through the dovetail joint so that a screw (18) can be inserted into a threaded hole in the dovetail protrusion (14) on the neck.

* * * * *